US007695036B2

(12) United States Patent
Smetana

(10) Patent No.: US 7,695,036 B2
(45) Date of Patent: Apr. 13, 2010

(54) SNOW SWEEPING DEVICE

(76) Inventor: Robert J. Smetana, 21922 Inglenook Ct., Deer Park, IL (US) 60010

( * ) Notice: Subject to any disclaimer, the term of this patent is extended or adjusted under 35 U.S.C. 154(b) by 124 days.

(21) Appl. No.: 11/975,412

(22) Filed: Oct. 19, 2007

(65) Prior Publication Data

US 2009/0100625 A1 Apr. 23, 2009

(51) Int. Cl.
*E01H 5/02* (2006.01)

(52) U.S. Cl. ..... 294/54.5; 15/245; 37/285

(58) Field of Classification Search ..... 15/244.1, 15/244.4, 245; 294/54.5, 57; 37/285
See application file for complete search history.

(56) References Cited

U.S. PATENT DOCUMENTS

| | | | | | |
|---|---|---|---|---|---|
| 950,012 | A | | 2/1910 | Bender | |
| 1,514,076 | A | * | 11/1924 | Brown | 37/266 |
| 1,922,998 | A | | 8/1933 | Williams | |
| 2,163,638 | A | * | 6/1939 | Vaughn | 15/244.1 |
| 2,735,129 | A | | 2/1956 | Lorenz | |
| D181,211 | S | * | 10/1957 | Lindstrom | D32/50 |
| 2,867,827 | A | | 1/1959 | Gantz | |
| 3,054,127 | A | * | 9/1962 | Petsch et al. | 15/244.1 |
| 3,134,124 | A | | 5/1964 | Horn | |
| 3,307,212 | A | | 3/1967 | MacInnes | |
| 3,324,494 | A | | 6/1967 | Vosbikian | |
| D227,199 | S | | 6/1973 | Payne | |
| 4,153,287 | A | | 5/1979 | Townsend | |
| 4,317,250 | A | * | 3/1982 | Shutts | 15/244.1 |
| 4,597,204 | A | | 7/1986 | Heiden | |
| D285,736 | S | * | 9/1986 | Seely | D32/41 |
| 4,756,039 | A | | 7/1988 | Pardo | |
| 4,785,489 | A | | 11/1988 | Von Doehren | |
| D302,059 | S | | 7/1989 | Sanders | |
| 4,848,819 | A | * | 7/1989 | Moorefield | 294/54.5 |
| 4,856,136 | A | | 8/1989 | Janssen | |
| 5,067,197 | A | * | 11/1991 | Cormier | 15/244.1 |
| 5,117,530 | A | * | 6/1992 | Rank | 15/245 |
| 5,309,654 | A | | 5/1994 | Mathis | |
| D355,075 | S | | 2/1995 | Stone | |
| D391,714 | S | | 3/1998 | Kilander | |
| 6,038,794 | A | | 3/2000 | Kilander | |
| 6,813,800 | B2 | * | 11/2004 | Liccardi | 15/228 |

* cited by examiner

*Primary Examiner*—Dean J Kramer
(74) *Attorney, Agent, or Firm*—Meroni & Meroni, P.C.; Charles F. Meroni, Jr.; Christopher J. Scott

(57) ABSTRACT

A sweeping device effectively sweeps snow and the like from variously constructed stairs. The device comprises a handle and wedge-shaped sweeping element or block. The sweeping element is preferably constructed from semi-rigid material and comprises a top side, a bottom side, a back side, a front side, and opposed lateral sides. The top and bottom sides are rectangular and parallel, while the lateral sides are quadrangular thereby defining opposed, anterior and posterior matter-sweeping surfaces. A lower end of the handle is threadably attached to the sweeping block or element for enabling a user to sweep matter such as lightly accumulated snow from stairs via the matter-sweeping surfaces.

9 Claims, 5 Drawing Sheets

SNOW SWEEPING DEVICE

BACKGROUND OF THE INVENTION

1. Field of the Invention

The disclosed invention generally relates to an apparatus for sweeping matter from surfaces. More particularly, the disclosed invention relates to an apparatus for sweeping snow and similar other matter from stairs having varied construction.

2. Brief Description of the Prior Art

Sweeping devices are well known in the arts. A common sweeping device is typified by a broom or duster comprising stiff fibers attached to, and roughly parallel to, a cylindrical handle, the broomstick. Less common are sweeping devices or matter-moving devices formed from a head of uniform construction attached to a handle or broomstick for sweeping or pushing matter (as opposed to lifting matter). Some of the more pertinent prior art disclosures relating to sweeping devices for sweeping snow or similar other matter are briefly described hereinafter.

U.S. Pat. No. 2,735,129 ('129 patent), which issued to Lorenz, discloses a Sponge Rubber Broom. The '129 patent teaches a sponge rubber broom comprising a body and handle, a socket in the body for the handle, a relatively stiff yet flexible reinforcing element integral with the socket, said reinforcing element tapering downwardly and tapering outwardly from it central portion, and elongated unitary sponge rubber main body portion fixed thereto and completing enclosing the reinforcing element, the sponge rubber body portion having straight parallel sides, downwardly and outwardly sloping ends, and a beveled bottom surface, an integral skin partially enclosing the sides and the entire area of the bottom surface of the sponge rubber body portion, said integral skin being cut away adjacent the lower periphery of the broom portion, said cut away portion exposing the inner porous sponge rubber body for better collection and absorption of foreign materials.

U.S. Pat. No. 4,597,204 ('204 patent), which issued to Heiden, discloses a Snow Pusher with Adjustable Handle. The '204 patent teaches a manual snow pusher comprising a resilient rubber blade connected along the base of a hood-like snow diverting member of galvanized metal plate. An elongate handle is pivotally attached to a latch plate at the back of the snow diverting member, allowing the angle of the handle relative to the length of the blade to be adjusted. The handle has a spring loaded pin which can be engaged in any one of a series of holes formed around the arcuate periphery of the latch plate in order to releasably secure the handle in a selected angular position.

U.S. Pat. No. 5,309,654 ('654 patent), which issued to Mathis, discloses a Snow and Ice Broom. The '654 patent teaches a new and improved combined snow pusher, ice chopper, and broom apparatus for clearing a surface includes a handle which is supported by a support and which projects upward from the top of the support at a first acute angle with respect to the support. Bristles are supported by the support, and the bristles project downward from the bottom of the support by a first distance. A panel element is supported by the support at the front of the support. The panel element is connected directly to the support, and the bottom end of the panel element projects downward past the bottom of the support by a second distance. The second distance is less than the first distance, whereby the portion of the panel element which extends below the support element protects the interface between the bristles and the support, whereby the panel element does not contact the surface to be cleared. The bottom end of the panel element includes a sharp lower edge. In a first mode of operation, the bristles are placed on the surface to be cleared, the panel element is used to push material out of a path on the surface, and the bristles are used to sweep material out of the path on the surface. In a second mode of operation, the apparatus is rotated 180 degrees, and the sharp edge of the panel element is placed on the surface to be cleared. In this mode, the apparatus can be used for chopping ice.

U.S. Pat. No. 6,038,794 ('794 patent), which issued to Kilander, discloses a Combined Broom and Rake. The '794 patent teaches a snow broom comprising a scraper element and multiple sweeping elements positioned on opposite sides thereof. The scraper element is in the preferred form of a sheet of relatively stiff plastic and includes serrations formed on its lower edge. The lower edge of the scraper element is divided into a plurality of tines by cuts extending from the lower edge. The inner sweeping elements positioned adjacent to and on opposite sides of the scraper element are formed from a sheet of foamed plastic of a flexibility to conform to the surface being swept and having a lower edge parallel to and spaced slightly above the lower edge of the scraper element. The outer sweeping elements are formed from a sheet of extruded plastic to which snow does not have an affinity to stick. In addition to providing a sweeping function, the outer sweeping elements provide protection and stiffening for the inner sweeping elements. The scraper and sweeping elements are attached together in a stacked arrangement and are secured to a handle by a shroud, with the handle extending at a non-perpendicular angle to the lower edges of the scraper and sweeping elements.

SUMMARY OF THE INVENTION

Accordingly, it is an object of the present invention to provide a low cost sweeping device for sweeping minor accumulations of snow and similar other debris from variously constructed stairs. In order to effectively sweep snow and the like from variously constructed stairs, the present invention provides a sweeping device comprising a low cost handle and low cost head attached to the handle, which head is of specific geometric configuration for both sweeping action and adjusting to stairs of various configuration. The sweeping element or block is preferably constructed from slightly flexible rubber so that it can sweep stairs without leaving scratches. On one side of the sweeping element, there is a 90 degree angle, which angle is used for sweeping snow off of (typically concrete) stairs where the stairs are perpendicular and flush at the riser-tread junctions. The other side is angled to accommodate (typically wooden) stairs having treads that overhang the underlying riser. In other words, when the stairs have an overhang, the user can still maneuver under the overhang and remove all of the snow all the way back to the riser.

The handle is essentially a state of the art, screw-in broom handle. In order to bolster the attachment junction, it is contemplated that a nail, screw, or similar other fastening hardware element could well function to fasten the handle to the sweeping element. In this regard, it is noted that snow can be heavy, and a more robust handle-to-head junction is preferred. Further, a slightly elongated handle is contemplated so that the user can start at the top of the stairs and work the user's way down to the bottom of the stairs.

The sweeping device thus essentially comprises an elongate handle and a wedge-shaped block or element. The handle has upper and lower handle ends; and the wedge-shaped block has a top side, a bottom side, a back side, a front side, and opposed lateral sides. The top and bottom sides are rectangular and parallel, while the lateral sides are quadrangular thereby defining opposed, anterior and posterior matter-sweeping surfaces. The matter-sweeping surfaces are angled relative to the top and bottom sides by way of the quadrangular lateral sides. The lower handle end is attached to the sweeping block or element for enabling a user to sweep matter such as lightly accumulated snow from stairs via the matter-sweeping surfaces.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings.

DETAILED DESCRIPTION OF THE PREFERRED EMBODIMENT

Figure 1:
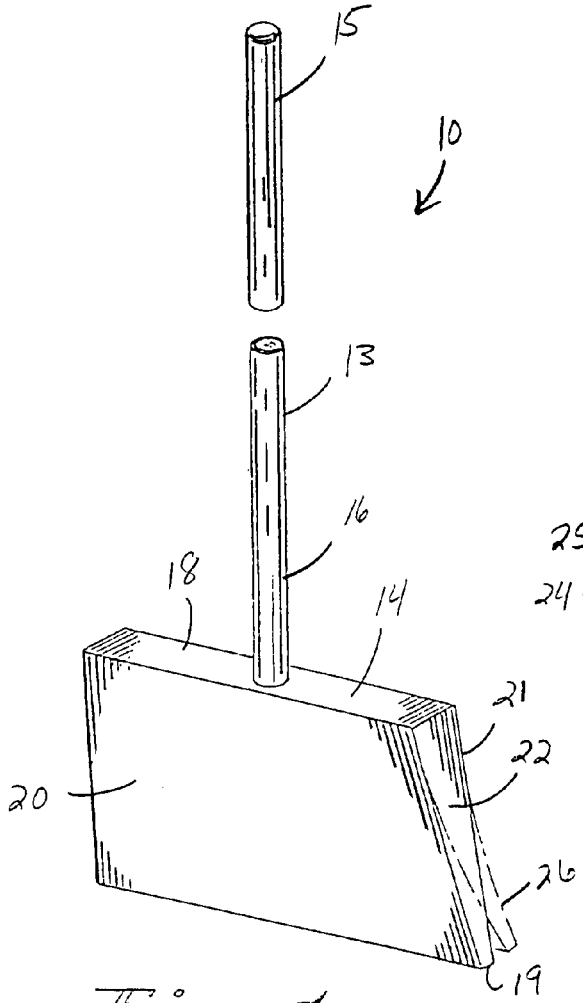
FIG. 1 is a top, posterior perspective view of the sweeping device according to the present invention showing a fragmentized handle thereof to shown upper and lower ends of the handle.
Figure 2:
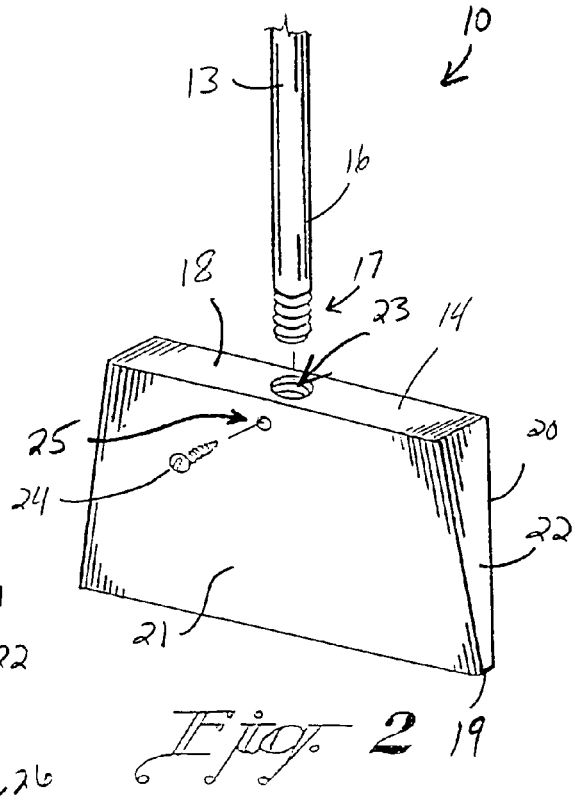
FIG. 2 is a fragmentary, anterior perspective view of the sweeping device according to the present invention showing the lower handle end exploded from the sweeping element.

Referring now to the drawings with more specificity, the preferred embodiment of the present invention concerns sweeping device 10 as illustrated and referenced in FIGS. 1-6, 8, and 9. It is contemplated that the sweeping device 10 according to the present invention is primarily intended for use in sweeping accumulated snow 11, debris, and other similar matter from stairways 12 as generally depicted in FIGS. 5, 6, 8, and 9. To achieve these and other readily apparent objectives, the snow or stair-sweeping device 10 of the present invention preferably comprises an elongate handle 13 as illustrated and referenced in FIGS. 1-6, 8, and 9; a matter-moving or matter-sweeping block or element 14 as illustrated and referenced in FIGS. 1-9, inclusive; and optional handle-to-block fastening means for fastening the handle 13 to the block 14, as may be preferably defined by the a fastener 24 as illustrated and referenced in FIGS. 1, 3, and 4.

Figure 3:
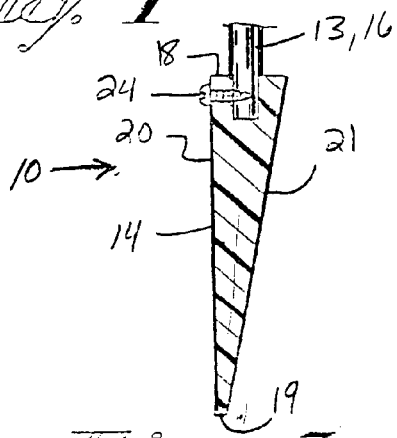
FIG. 3 is a fragmentary cross-sectional view through a smooth lower handle end, a plastic sweeping element, and an optional threaded fastener as assembled.
Figure 4:
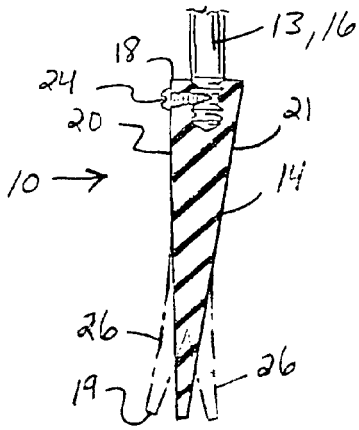
FIG. 4 is a fragmentary cross-sectional view through a threaded lower handle end, a rubber sweeping element, and an optional threaded fastener as assembled.

From an inspection of the noted figures, as well as a consideration of the state of the art in general, it may be readily understood that the handle 13 inherently has and upper handle end or portion as at 15 in FIG. 1, and a lower handle end or portion as at 16 in FIGS. 1-6, 8, and 9. It is contemplated that the lower handle portion or end 16 is preferably provided with threads or is threaded as referenced at 17 in FIG. 1 and as generally depicted in FIG. 4. It is contemplated that the handle 13 may be preferably constructed from rigid or semi-rigid materials such as, but not limited to, wood, polymeric, metallic, or similar force-translating type materials. Preferably, the handle 13 should be constructed from a material of relatively low cost so as to minimize the manufacturing costs of device 10.

It is contemplated that the matter-moving or matter-sweeping block 14 may be constructed from rigid or semi-rigid materials such as polymeric or plastic material (as generally depicted in FIG. 3 with hatch markings) or hardened rubber material (as generally depicted in FIG. 4 with hatch markings). When constructed from a semi-rigid material, it is contemplated that the semi-rigid material may well enable block flexibility adjacent the bottom side 19 or bottom portion of the block as generally depicted in FIGS. 1 and 4 at 26. The block flexibility 26 enables certain squeegee action while sweeping accumulated snow 11 or debris via the snow-sweeping planes. In this regard, it should be noted that the squeegee action will prevent the device from being clogged with the material being removed and otherwise reducing its effectiveness.

The block, in any event, is preferably of uniform, solid construction and is preferably of a wedge- or ramp-shaped configuration as may be gleaned from an inspection of the noted figures. The ramp- or wedge-shaped configuration of the block 14 preferably has a top or superior side 18, a bottom or inferior side 19, a back or posterior side 20, a front or anterior side 21, and opposed lateral sides 22 as further referenced in the noted drawings, with particular attention being given thereto in FIG. 7.

It may be readily understood from an inspection of the noted figures that the top side 18 and the bottom side 19 are preferably rectangular in shape, planar, and parallel. The top side 18 or top portion of the block 14 preferably has a centralized threaded aperture 23 as referenced in FIGS. 1 and 7. The front side 21, back side 20, and lateral sides 22 are preferably quadrangular and planar, thereby defining opposed, anterior and posterior snow or stair-sweeping planes angled relative to the top side 18 and bottom side 19. The threaded lower handle end 17 is thus threadably received in the threaded aperture 23 for attaching the handle 13 to the block 14 and enables a user to sweep accumulated snow 11, debris, and similar other matter via the snow- or stair-sweeping planes of the anterior and posterior portions or surfaces (sides 21 and 22) of the block 10.

The fastener 24 member is preferably constructed from a substantially rigid, metallic material and is preferably threaded so as to effect a more robust attachment to the threaded lower handle end 17. Notably, the block 10 may further comprise intersecting female structure defined by the threaded aperture 23 and a fastener-receiving aperture as at 25 in FIG. 2. The intersection of the apertures 23 and 25 or bores may be understood from a comparative inspection of FIGS. 2 and 4. The fastener 24 preferably has head and pointed fastener ends, which pointed fastener end is piercedly handle-received in the block-received lower handle end 17. In other words, the lower handle end 17 is block-received via the aperture 23. Following reception of the lower handle end 17, the pointed fastener end may pierce the structure of the lower handle end 17 for expanding and forcing the lower handle end 17 into greater frictional contact with the block 14. The fastener 24 functions to enhance or secure attachment of the handle 13 to the block 14.

The lateral sides 22 of the sweeping device 10 ramp up from the bottom side 19 to the top side 18 for enhancing block strength adjacent the lower handle end 16. In other words, the top or upper portion of the block 13 comprises relatively more volume than the bottom or lower portion of the block 13. The added bulk adjacent the received lower handle end 16 is believed to provide the mechanism with added material strength for enabling the user to sweep snow 11 and the like, which swept material may be weighty and resist sweeping motion, thereby stressing the material of the block 13.

Figure 5:
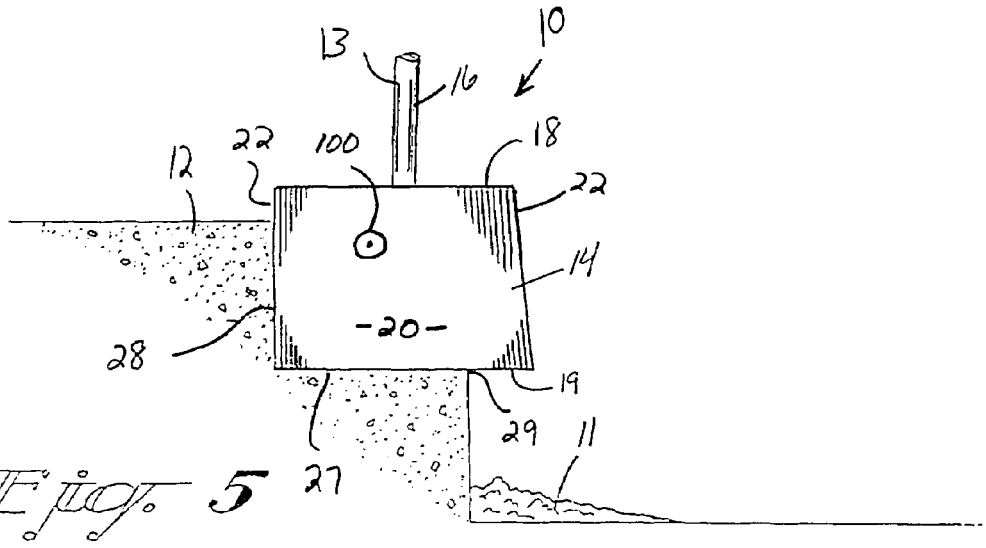
FIG. 5 is a fragmentary transverse or profile type sectional view through concrete stairs with a fragmentary sweeping device according to the present invention oriented for side-to-side sweeping action through maximized concrete stair space.
Figure 6:
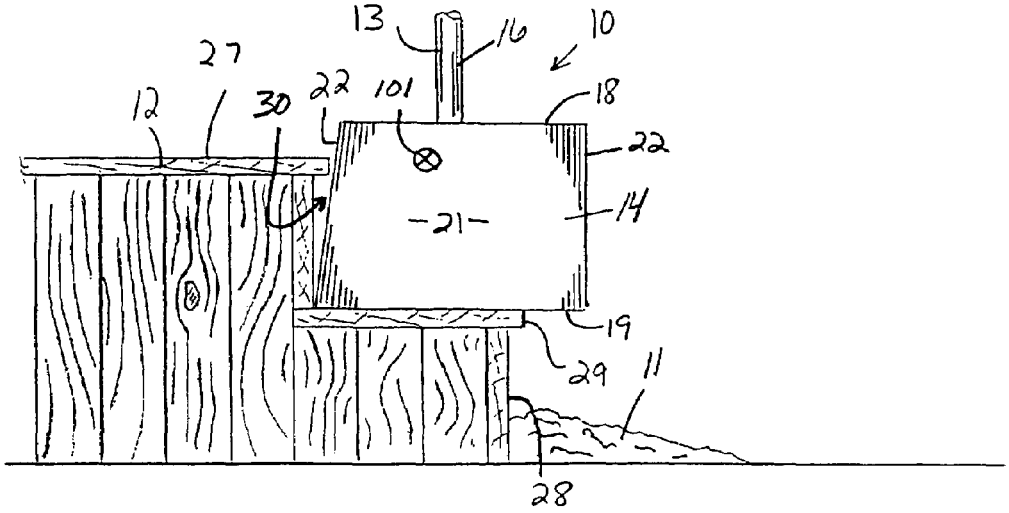
FIG. 6 is a fragmentary transverse or profile type sectional view through wooden stairs with a fragmentary sweeping device according to the present invention oriented for side-to-side sweeping action through maximized wooden stair space.
Figure 7:
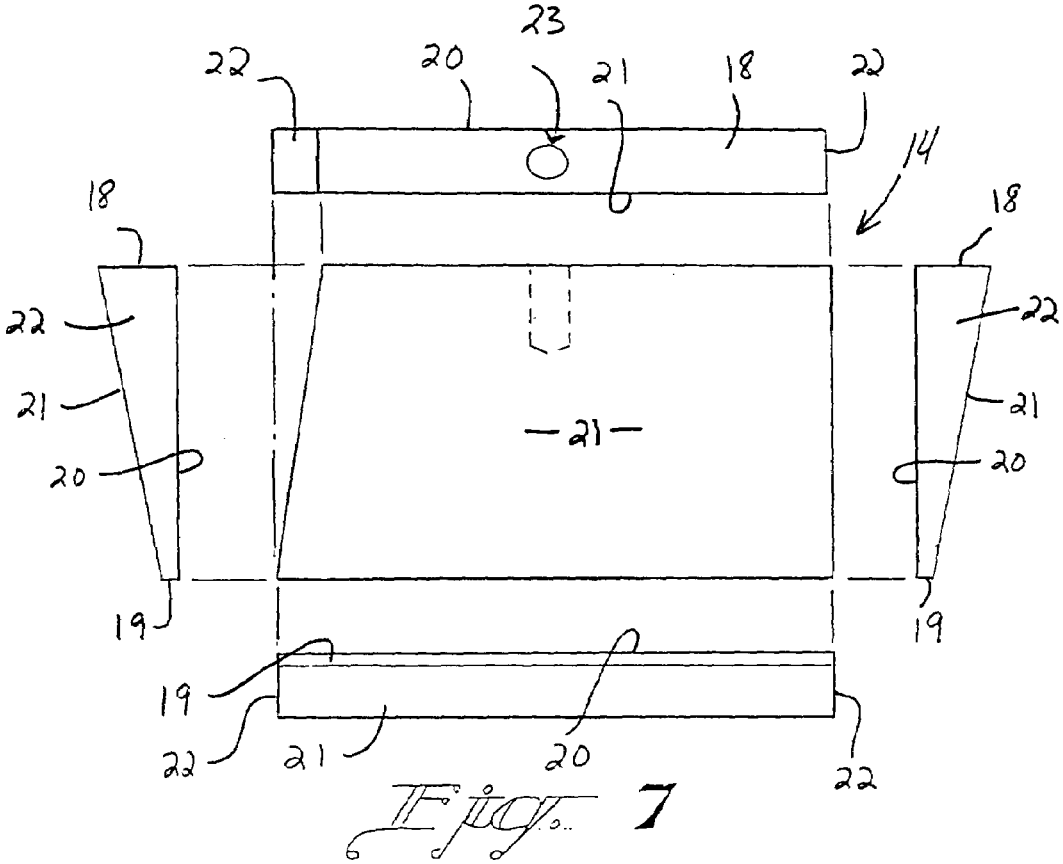
FIG. 7 is a centralized anterior plan type depiction of the sweeping element with plan views of the top side, bottom side, and opposing lateral sides exploded from the centralized anterior plan type depiction to comparatively show geometric relationships.
Figure 8:
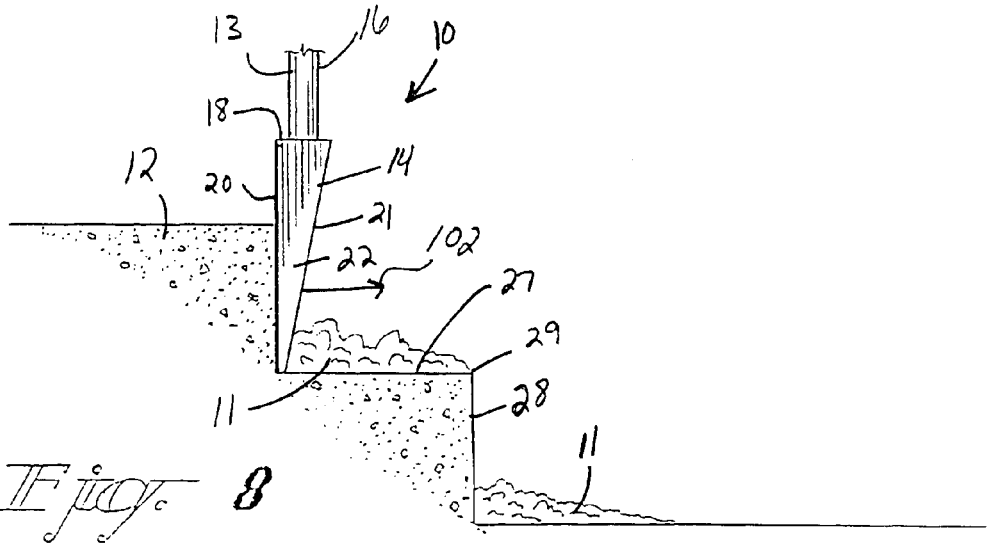
FIG. 8 is a fragmentary transverse or profile type sectional view through concrete stairs with a fragmentary sweeping device according to the present invention oriented for riser-to-tread terminus sweeping action through maximized concrete stair space.

A select lateral side 22 of the sweeping device 10 is preferably orthogonal relative to the top side 18 and bottom side 19 as perhaps may be most readily understood from an inspection of FIGS. 5-7. The lateral side 22 orthogonally situated relative to the top and bottom sides 18 and 19 is designed for effectively sweeping snow 11 and other debris from stairs 12 having orthogonal and flush tread-to-riser junctions as generally depicted in FIGS. 5 and 8. In other words, the transverse profile of the stairs 12 in FIGS. 5 and 8 is akin to stepped rectangles where the terminus 29 of a landing or tread 27 is flush with the underlying riser 28, thereby effecting (typically orthogonal) flush tread-to-riser junctions. It may be seen from an inspection of FIG. 5 that the select lateral side 22 and the bottom side 19 are depicted as snugly contacting the stairs 12 and eliminating any gaps therebetween that may otherwise develop.

Figure 9:
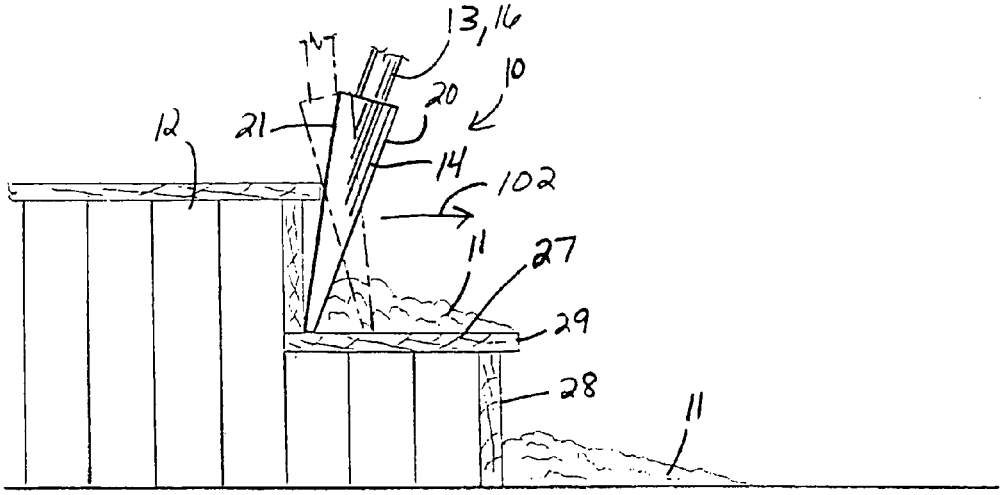
FIG. 9 is a fragmentary transverse or profile type sectional view through wooden stairs with a fragmentary sweeping device according to the present invention oriented for riser-to-tread terminus sweeping action through maximized wooden stair space.

The opposing lateral side 22 is preferably angled relative to the top side 18 and the bottom side 19. In this regard, it is contemplated that the angled lateral side 22 and bottom side 19 may well function to sweep snow 11 and the like from stairs 12 having orthogonal and staggered riser-to-tread junctions as generally depicted in FIGS. 6 and 9. In other words, the transverse profile of the stairs 12 in FIGS. 6 and 9 comprises landings or treads 27 that overhang the risers 28. A flush arrangement is thus not seen in stairs 12 of this type or construction. In order to maximize the effectiveness of the sweeping device 10, it is contemplated that the angled lateral side 22 and the bottom side 19 may minimize the gap 30 intermediate the lateral side 22 and the riser(s) 28.

The foregoing descriptions attend to sweeping motion as generally depicted in FIGS. 5 and 6. It may be understood from FIGS. 5 and 6 that the same depict a side-to-side sweeping motion as depicted by vector arrow 100 (out of page in FIG. 5) and vector arrow 101 (into page in FIG. 6). Users may also elect to sweep snow 11 and the like from the risers 28 toward the tread termini 29 as generally depicted at vector arrow 102 in FIGS. 8 and 9. In this regard, it is contemplated that the back side 20 is preferably orthogonal to the top and bottom sides 18 and 19 for enabling the user to effectively sweep snow 11 from a riser-to-tread junction past a tread terminus 29, wherein the riser-to-tread junction is flush (as depicted in FIG. 8). The front side 21, being angled relative to the top and bottom sides 18 and 19 enables the user to effectively sweep snow 11 from a riser-to-tread junction past a tread terminus 29, wherein the riser-to-tread junction is staggered (as depicted in FIG. 9).

While the above descriptions contain much specificity, this specificity should not be construed as limitations on the scope of the invention, but rather as an exemplification of the invention. For example, the invention may be said to essentially disclose a sweeping device for sweeping matter from surfaces, which sweeping device comprises an elongate handle, a wedge-shaped block, and certain handle-to-block fastening means. The handle has upper and lower handle ends; the block has top and bottom block portions; and the handle-to-block fastening means function to fasten the lower handle end to the top block portion. The lower handle end is thus fastened to the top block portion via the handle-to-block fastening means for enabling a user to sweep matter via the wedge-shaped block.

The wedge-shaped block may preferably comprise a top side, a back side, a front side, and opposed lateral sides, the lateral sides defining anterior and posterior matter-sweeping surfaces angled relative to the top side. The lower handle end is preferably threaded and the top portion preferably comprises a threaded aperture (thereby exemplifying certain handle-to-block fastening means). The lower handle end may thus be threadably received in the threaded aperture for threadably attaching the handle to the block.

Figure 10:
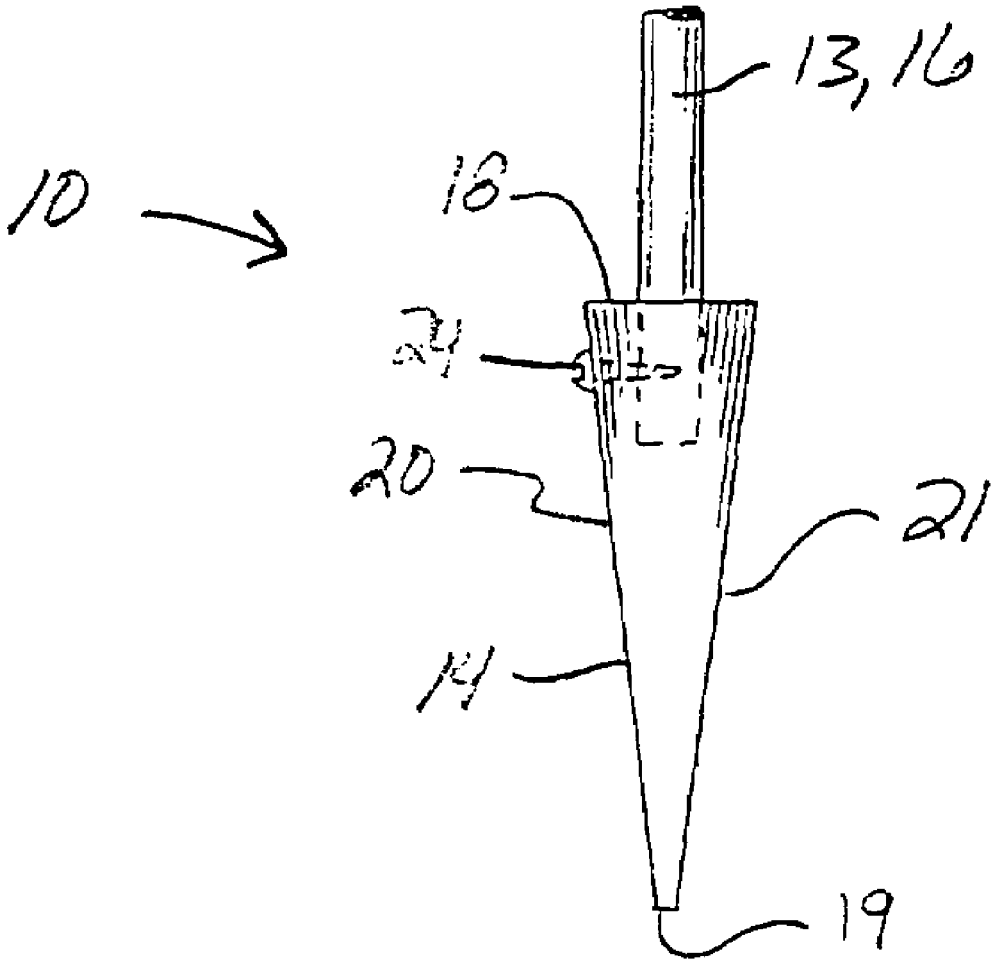
FIG. 10 is a fragmentary cross-sectional view through a smooth lower handle end, an alternative sweeping element, and an optional threaded fastener as assembled.

The lateral sides of the sweeping device ramp up from the bottom portion to the top portion for enhancing block strength at the point of attachment adjacent the lower handle end. The block may be preferably constructed from a semi-rigid material for enabling block flexibility adjacent the bottom portion, which block flexibility enables certain squeegee action and prevents scratching of the underlying surface while sweeping matter via the matter-sweeping surfaces and bottom side. The front and back sides of the sweeping block are preferably quadrangular such that a select lateral side is orthogonal to the top side for sweeping matter from stairs having orthogonal and flush tread-to-riser junctions. The opposing lateral side is thus preferably angled relative to the top side for sweeping matter from stairs having orthogonal and staggered riser-to-tread junctions. The back side may preferably be orthogonal to the top side for enabling the user to effectively sweep matter from a riser-to-tread junction past a tread terminus. Alternatively, however, it is contemplated that the sweeping block or element may be transversely configured as generally depicted in FIG. 10, which transverse profile is roughly akin to an isosceles trapezoid or triangle.

Although the invention has been described by reference to a number of embodiments it is not intended that the novel apparatus or device be limited thereby, but that modifications thereof are intended to be included as falling within the broad scope and spirit of the foregoing disclosure and the appended drawings.

I claim:

1. A snow-sweeping device, the snow-sweeping device for sweeping accumulated snow, the snow-sweeping device comprising:

an elongate handle, the handle having upper and lower handle ends, the lower handle end being threaded;

a wedge-shaped block, the block being constructed from a semi-rigid material and having a top side, a bottom side, a back side, a front side, and opposed lateral sides, the top and bottom sides being rectangular and parallel, the top side having a centralized threaded aperture, the front, back, and lateral sides being quadrangular thereby defining opposed, anterior and posterior snow-sweeping planes angled relative to the top and bottom sides; and a fastener for enhancing fastened attachment of the handle to the block, the fastener having head and pointed fastener ends, the lower handle end being threadably received in the threaded aperture for attaching the handle to the block, the pointed fastener end being received in the lower handle end, the lateral sides ramping up from the bottom side to the top side for enhancing block strength adjacent the lower handle end, a first lateral side being orthogonally angled relative to the top and bottom sides, said first lateral side and the bottom side for sweeping snow from stain having orthogonal and flush tread-to-riser junctions, a second lateral side being non-orthogonally angled relative to the top and bottom sides, said second lateral side and bottom side for sweeping snow from stairs having orthogonal and staggered riser-to-tread junctions, said semi-rigid material enabling block flexibility adjacent the bottom side, the handle enabling a user to sweep accumulated snow via the snow-sweeping planes, the block flexibility for enabling squeegee action while sweeping accumulated snow via the snow-sweeping planes.

2. The snow-sweeping device of claim 1 wherein the back side is orthogonal to the top and bottom sides for enabling the user to selectively sweep snow from a riser-to-tread junction past a tread terminus.

3. A stair-sweeping device, the stair-sweeping device for sweeping matter from stairs, the stair-sweeping device comprising:

an elongate handle, the handle having upper and lower handle ends; and a wedge-shaped block, said block having a top side, a bottom side, a back side, a front side, and opposed lateral sides, the top and bottom sides being rectangular and parallel, the lateral sides being quadrangular thereby defining opposed, anterior and posterior matter-sweeping surfaces angled relative to the top and bottom sides, the lateral sides ramping up from the bottom side to the top side for enhancing block strength adjacent the lower handle end, the lower handle end being attached to the block for enabling a user to sweep matter from stairs via the matter-sweeping surfaces, the front and back sides being quadrangular, a first lateral side being orthogonally angled relative to the tap and bottom sides, said first lateral side and bottom side for sweeping matter from stairs having orthogonal and flush tread-to-riser junctions, a second lateral side thus being non-orthogonally angled relative to the top and bottom sides for sweeping matter from stairs having orthogonal and staggered riser-to-tread junctions.

4. The stair-sweeping device of claim 3 comprising a fastener, the fastener for fastening the handle to the block for enhancing handle-to-block attachment.

5. The stair-sweeping device of claim 3 wherein the lower handle end is threaded and the top side comprises a threaded aperture, the lower handle end being threadably received in the threaded aperture for attaching the handle to the block.

6. The stair-sweeping device of claim 3 wherein the block is constructed from a semi-rigid material, said semi-rigid material enabling block flexibility adjacent the bottom side, the block flexibility for enabling squeegee action while sweeping matter via the matter-sweeping surfaces.

7. The sweeping device of claim 3 wherein the back side is orthogonal to the top and bottom sides for enabling the user to selectively sweep matter from a riser-to-tread junction past a tread terminus.

8. A sweeping device, the sweeping device for sweeping matter from surfaces, the sweeping device comprising:

an elongate handle, the handle having upper and lower handle ends, the lower handle end being threaded;

a wedge-shaped block, the block being constructed from a semi-rigid material and having a top block portion, a bottom block portion, a top side, a back side, a front side, and opposed lateral sides, the top block portion having a threaded aperture, the lateral sides defining anterior and posterior matter-sweeping surfaces angled relative to the top side, the lower handle end being threadably received in the threaded aperture for threadably attaching the handle to the block, the lateral sides ramping up from the bottom portion to the top portion for enhancing block strength adjacent the lower handle end, the semi-rigid material enabling block flexibility adjacent the bottom portion, the handle for enabling a user to sweep matter via the wedge-shaped block, the semi-rigid material for enabling squeegee action while sweeping matter, the front and back sides being quadrangular, a first lateral side being orthogonally angled relative to the top side for sweeping matter from stairs having orthogonal and flush tread-to-riser junctions, a second lateral side thus being non-orthogonally angled relative to the top side for sweeping matter from stairs having orthogonal and staggered riser-to-tread junctions.

9. The sweeping device of claim 8 wherein the back side is orthogonal to the top side for enabling the user to effectively sweep matter from a riser-to-tread junction past a tread terminus.

* * * * *